US006142822A

United States Patent [19]

Wu

[11] Patent Number: 6,142,822

[45] Date of Patent: Nov. 7, 2000

[54] ELECTRICAL CONNECTOR HAVING LED DEVICE

[75] Inventor: Kun Tsan Wu, Tu-Chen, Taiwan

[73] Assignee: Hon Hai Precision Ind. Co., Ltd., Taipei Hsien, Taiwan

[21] Appl. No.: 09/220,989

[22] Filed: Dec. 23, 1998

[30] Foreign Application Priority Data

May 6, 1998 [TW] Taiwan ..... 87206976

[51] Int. Cl.[7] ..... H01R 3/00

[52] U.S. Cl. ..... 439/490

[58] Field of Search ..... 439/490, 488, 439/489, 638, 639, 676; 362/226, 800

[56] References Cited

U.S. PATENT DOCUMENTS 4,978,317 12/1990 Pocrass .
5,601,451 2/1997 Driones et al. ..... 439/490
5,685,737 11/1997 Morin et al. ..... 439/490
5,741,152 4/1998 Boutros ..... 439/490

*Primary Examiner*—Steven L. Stephan
*Assistant Examiner*—Eugene G. Byrd
*Attorney, Agent, or Firm*—Wei Te Chung

[57] ABSTRACT

An electrical connector includes an insulative housing, a pair of LED devices, a contact member, a pair of positioning members, and an EMI shield. The LED devices are fittingly attached to locating regions defined in a front portion of a top wall of the housing. Each positioning member is seated in a positioning space defined in a rear portion of the top wall of the housing whereby a guiding stem and a retaining post extending from a cover thereof are snugly received in a guiding groove and a retaining hole defined in the housing, respectively. A flange of each positioning member abuts against each LED device thereby securing the LED device to the housing. To replace the LED devices, the positioning members are removed from the housing by applying a lifting force on the flange.

15 Claims, 4 Drawing Sheets

ELECTRICAL CONNECTOR HAVING LED DEVICE

BACKGROUND OF THE INVENTION

1. Field of The Invention

The present invention relates to an electrical connector, and particularly to an electrical connector having LED device which can be easily assembled and disassembled.

2. The Prior Art

U.S. Pat. No. 4,978,317 discloses a receptacle connector for signal transmission. The connector includes a housing and a pair of LEDs which are integrally arranged within the housing in a position adjacent to an entrance of the housing. The LED will light up when signal transmission is activated. However, the LEDs are fixedly installed within the housing. If the LED fails the entire connector must be replaced thereby increasing costs. U.S. Pat. No. 5,601,451 and Taiwan Utility Pat. Nos. 85205536 and 85104436 disclose a detachable LED, however, disassembly of the LED requires a special tool, such as pliers, thereby resulting in an inconvenience for the user.

Hence, an improved cable connector having an easily detachable LED is requisite.

SUMMARY OF THE INVENTION

Accordingly, an objective of the present invention is to provide an electrical connector for input/output signal transmission having LED devices which are easily assembled and disassembled to a housing thereof without the use of an external tool.

To fulfill the above mentioned objectives, an electrical connector in accordance with the present invention includes an insulative housing, a pair of LED devices, a contact member, a pair of positioning members, and an EMI shield. The LED devices are fittingly attached to a top wall of the housing. Each positioning member is seated in a positioning space defined in a rear portion of the top wall of the housing whereby a guiding stem and a retaining post extending from a cover thereof are snugly received in a guiding groove and a retaining hole defined in the housing, respectively. A flange of each positioning member abuts against each LED device thereby securing the LED device to the housing. To replace the LED devices, the positioning members are removed from the housing by applying a lifting force on the flange.

These and additional objectives, features, and advantages of the present invention will become apparent after reading the following detailed description of the preferred embodiment taken in conjunction with the appended drawing figures.

DETAILED DESCRIPTION OF THE PREFERRED EMBODIMENT

Reference will now be made in detail to the preferred embodiment of the present invention.

Figure 1:
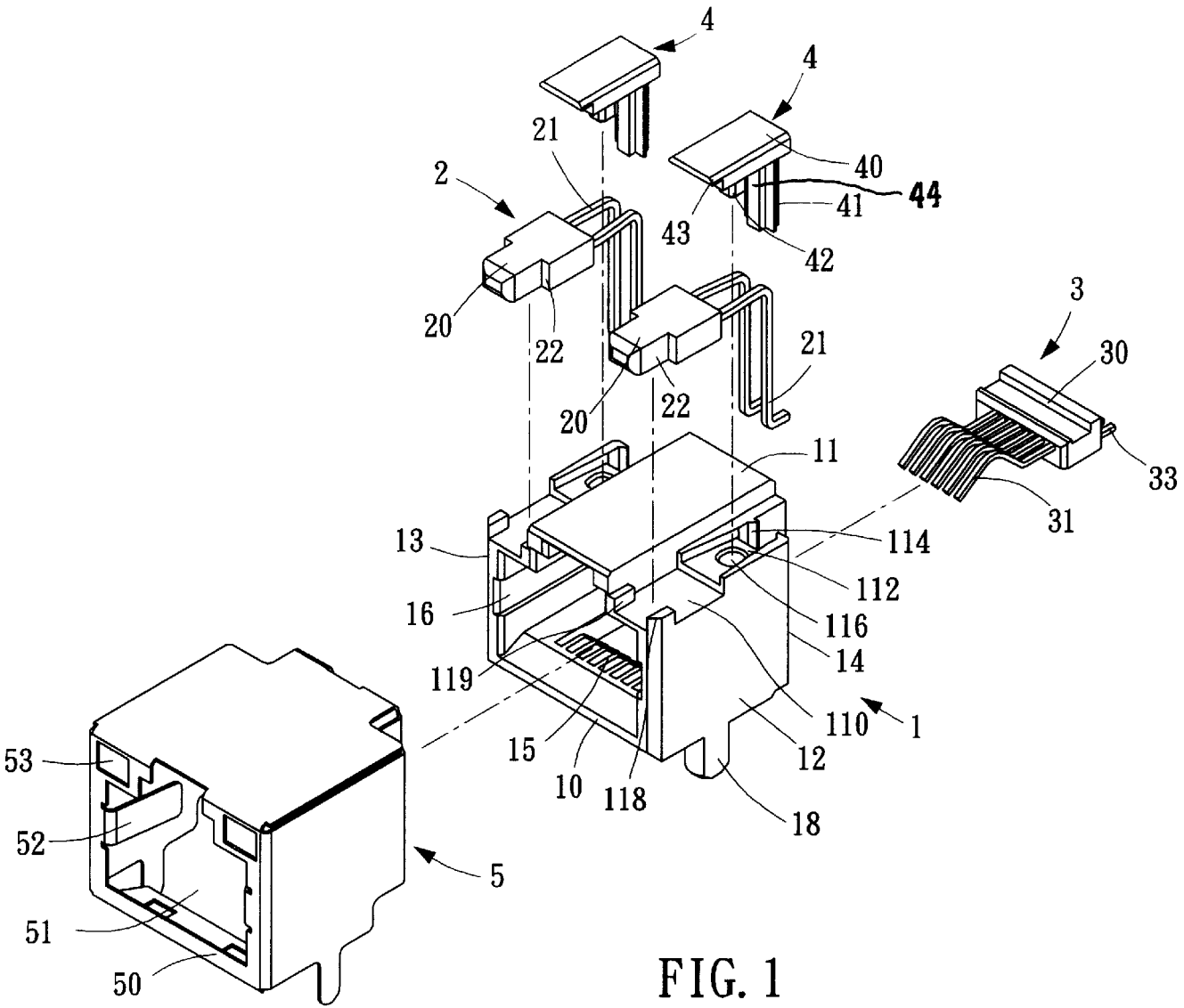
FIG. 1 is an exploded view of a cable connector in accordance with the present invention.

Referring to FIG. 1, an electrical connector in accordance with the present invention includes an insulative housing 1, a pair of LED devices 2, a contact member 3, a pair of positioning members 4, and an EMI shield 5.

The housing 1 comprises a base 10, a top wall 11 opposite the base 10, a pair of side walls 12, 13 formed between the base 10 and the top wall 11, and a rear wall 14 formed between the base 10, the top wall 11, and the side walls 12, 13. An entry space 15 for receiving a mating plug connector (not shown) is defined in the housing 1 opposite the rear wall 14. A pair of horizontal channels 16 are defined in opposite inner surfaces of the side walls 12, 13. The top wall 11 defines a pair of locating regions 110 in a front portion of a top face thereof and a pair of positioning spaces 112 in a rear portion the top face thereof. A vertical guiding groove 114 is defined in the rear wall 14 in communication with the positioning space 112. A retention hole 116 is defined through the top wall 11 whereby each positioning space 112 communicates with the entry space 15. A pair of tabs 118, 119 are formed upwardly extending from the top face 11 near a front portion of the locating region 110. A mounting post 18 extends from a bottom portion of each side wall 12, 13.

Each LED device 2 includes an LED cell 20 and a pair of L-shaped legs 21 extending from a rear face of the LED cell 20. A pair of shoulders 22 are formed on opposite sides of each LED cell 20. The contact member 3 includes a bracket 30 with a plurality of terminals 31 received therein and extending therefrom. Tails 33 of the terminals 31 extend beyond the bracket 30. Each positioning member 4 comprises a cover 40 with a guiding stem 41 and a retaining post 42 extending downward therefrom. A flange 43 is formed on a front portion of the cover 41. The EMI shield 5 is shaped to enclose the housing 1 and comprises a mating face 50, an opening 51 defined in the mating face 50, and a pair of spring arms 52 formed on opposite inner side walls thereof. A pair of windows 53 are defined through opposite upper corners of the mating face 50.

Figure 2:
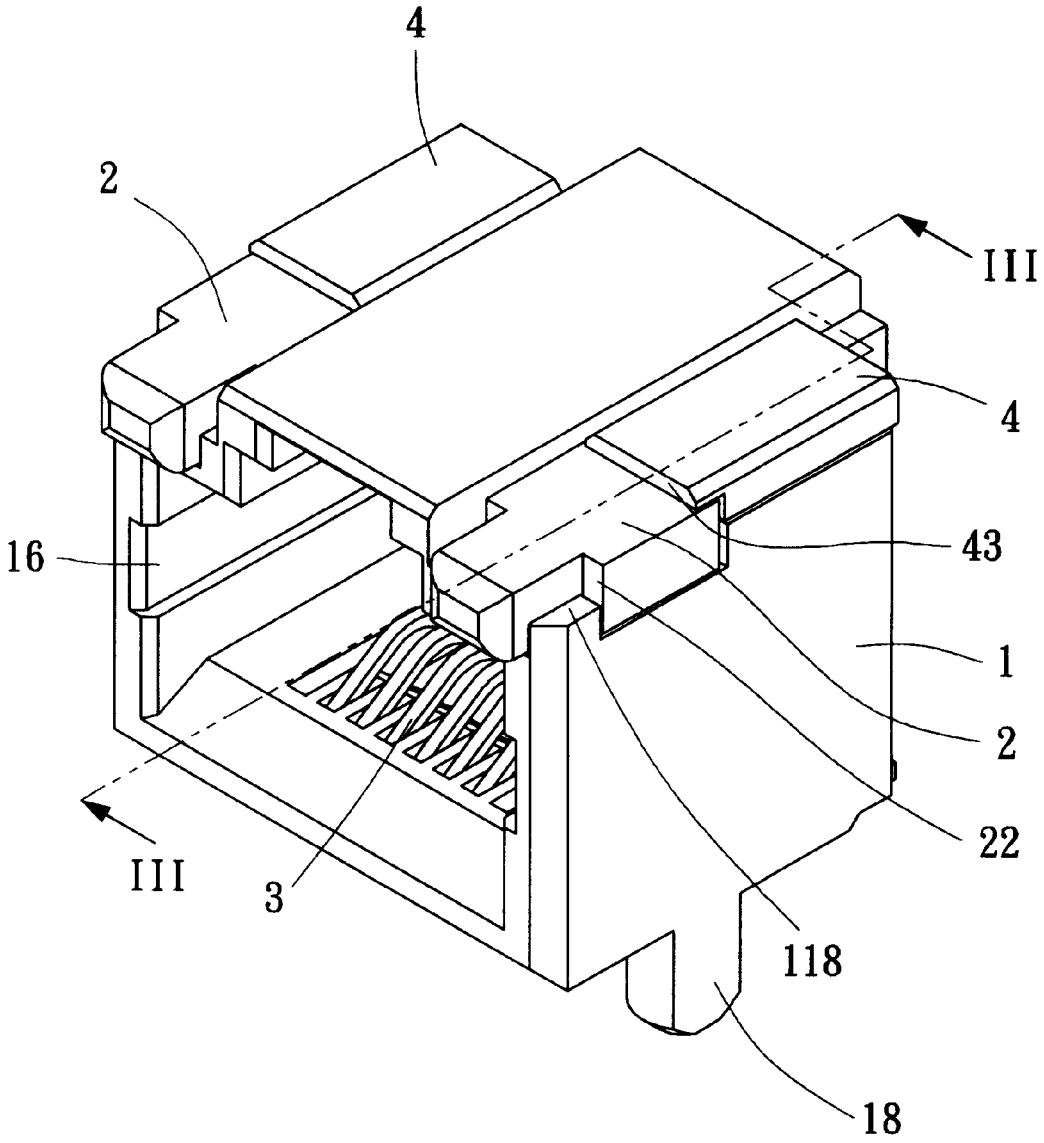
FIG. 2 is a partially assembled view of FIG. 1 with an EMI shield removed therefrom.
Figure 3:
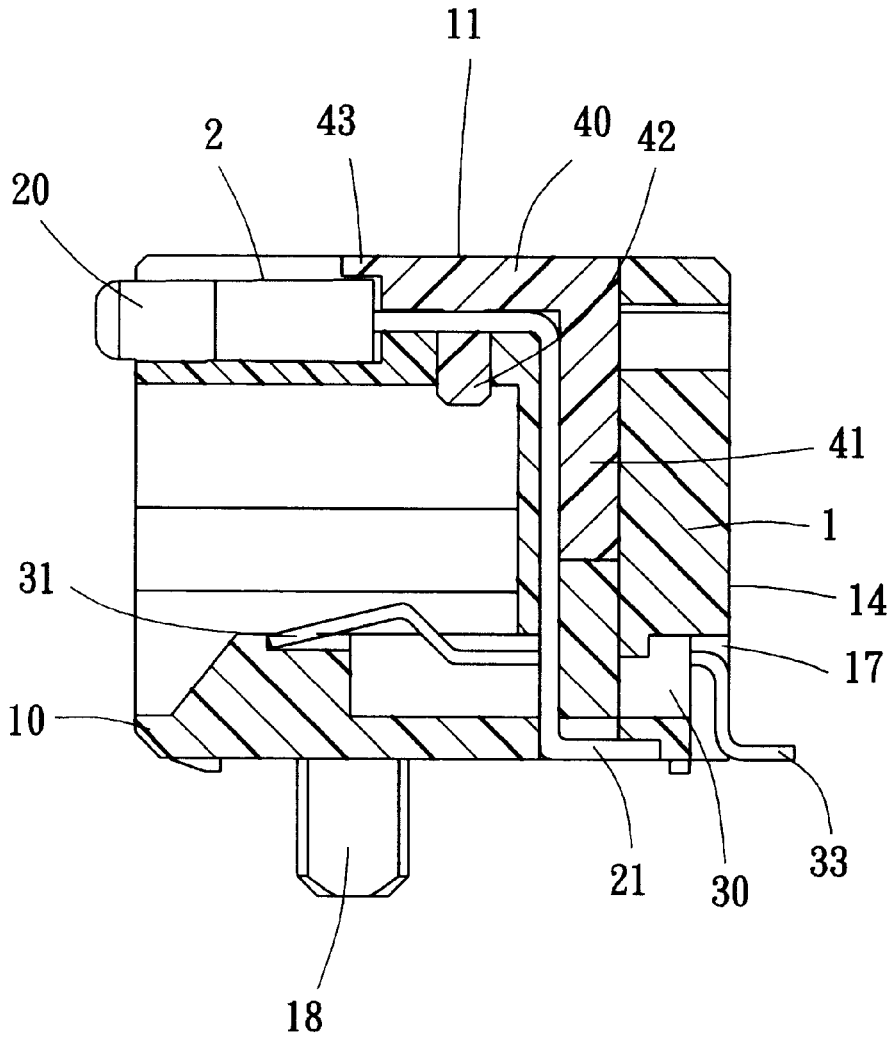
FIG. 3 is a cross sectional view taken along line III—III of FIG. 2.
Figure 4:
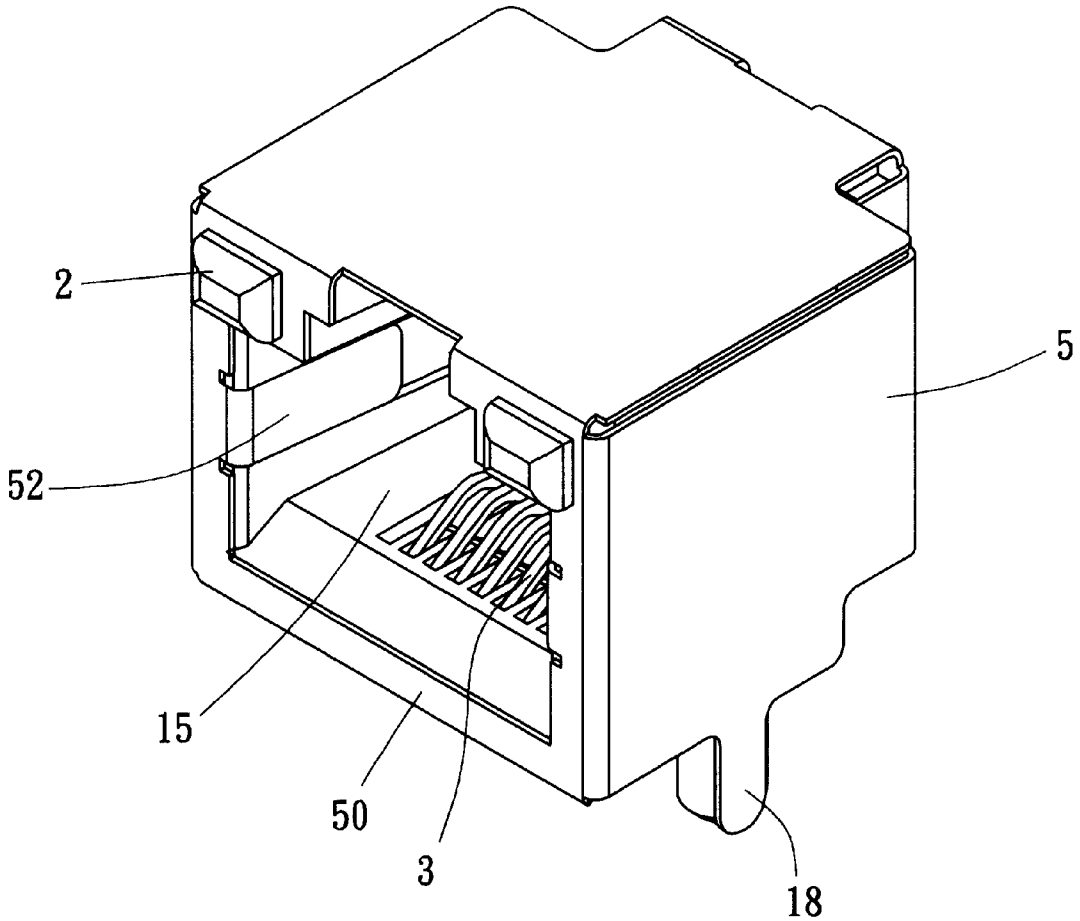
FIG. 4 is a fully assembled view of FIG. 1.

In assembly, the contact member 3 is assembled to the base 10 of the housing 1 and the tails 33 extend through passageways 17 (FIG. 3) defined in the rear wall 14 thereof for electrically connecting with solder pads formed on a printed circuit board (not shown). The LED devices 2 are fittingly attached to the housing 1 whereby the LED cells 20 are disposed on the corresponding locating regions 110 and the tabs 118, 119 abut against the shoulders 22. The legs 21 of the LED devices extend through the corresponding positioning space 112 and along the rear wall 14 of the housing 1 for connection to the PCB. Each positioning member 4 is seated in the corresponding positioning space 112 whereby the guiding stem 41 and the retaining post 42 are snugly received in the guiding groove 114 and the retaining hole 116, respectively, and the flange 43 abuts against the LED cell 21 thereby securing the LED device 2 to the housing 1 as seen in FIGS. 2 and 3, whereby the partition wall 44 is generally positioned between two spaced legs 21 of the LED devices. The EMI shield 5 is assembled to the housing 1 whereby the spring arms 52 are received in the channels 16 and the LED cells 20 extend through the windows 52 as seen in FIG. 4. The mounting posts 18 of the housing are then inserted into holes defined in the PCB for mounting the connector thereon.

To replace the LED devices 2, the shield 5 is detached from the housing 1 and the positioning members 4 are removed therefrom by applying a lifting force on the flange 43. The LED devices 2 can then be easily removed from the locating region 110 and replaced. The provision of the positioning members 4 facilitates manual disengagement of the LED devices 2 from the housing 1 without the use of an external tool thereby simplifying assembly. Since the electrical connector in accordance with the present invention allows for the replacement of LED devices 22, cost and waste are both significantly reduced. In brief, the installation of the LED devices on an external surface of the housing cooperates with the retention of the LED devices by an auxiliary positioning member, thus providing a more economic way for repair or replacement of the LED devices with regard to the associated housing, in comparison with the conventional build-in connector where the LED is either integrally or detachably embedded within the housing of the connector.

It is also noted that the positioning member 4 can hold not only the LED cell 20 by means of the flange 43 of the cover 40, but also the legs 21 by means of the cover 40 for the horizontal sections of the legs 21 and the stem 41 for the vertical sections of the legs 21.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector comprising:

an insulative housing including a base, a top wall opposite the base, a pair of side walls formed between the base and the top wall, and a rear wall formed between the base, the top wall, and the side walls, the top wall having a top face defining at least a locating region in a front portion thereof and at least a positioning space in a rear portion thereof;

at least an LED device including an LED cell disposed on the locating region and a pair of L-shaped legs extending from a rear face of the LED cell;

a contact member assembled to the base, including a bracket with a plurality of terminals received therein and extending therefrom; and at least a positioning member detachably assembled in the positioning space for securing the LED device to the housing, said positioning member comprising a cover, a guiding stem downwardly extending from the cover for snug reception within a vertical guiding groove defined in the rear wall and in communication with the positioning space;

wherein the LED device and the positioning member are fittingly attached to the housing, thereby facilitating replacement of the LED device after removal of the positioning member.

2. The connector as described in claim 1, wherein at least a tab is formed upwardly extending from the top wall near a front portion of the locating region for abutting against at least a shoulder formed on each LED cell.

3. The connector as described in claim 1, wherein the legs of the LED device extend through the positioning space and along the rear wall of the housing.

4. The connector as described in claim 1, wherein the positioning member further includes a retaining post downwardly extending from the cover for snug reception within a retention hole defined through the top wall, and a flange formed on a front portion of the cover for abutting against the LED cell, thereby securing the LED device to the housing.

5. The connector as described in claim 1 further comprising an EMI shield assembled to the housing, comprising at least a spring arm formed on an inner side wall thereof.

6. The connector as described in claim 5, wherein the housing defines at least a horizontal channel along an inner surface of at least one of the side walls for receiving the corresponding spring arm therein.

7. An insulative housing for an electrical connector, comprising a base, a top wall opposite the base, a pair of side walls formed between the base and the top wall, and a rear wall formed between the base, the top wall, and the side walls, the top wall defining at least a locating region and at least a positioning space in a top face thereof, a vertical guiding groove being defined in the rear wall and exposed to the top face, a retention hole being defined through the top wall, wherein an LED device is disposed on the locating region and a positioning member is detachably seated in the positioning space.

8. The housing as described in claim 7, wherein at least a tab is formed upwardly extending from the top wall near a front portion of the locating region for abutting against at least a shoulder formed on each LED device.

9. The housing as described in claim 7, wherein the locating region is defined in a front portion of the top wall and the positioning space is defined in a rear portion thereof.

10. The housing as described in claim 9, wherein the guiding groove receives a guiding stem of the positioning member, the retention hole receives a retaining post of the positioning member, and a flange of the positioning member abuts against the LED device thereby securing the LED device to the housing.

11. The housing as described in claim 7, wherein the housing defines at least a horizontal channel along an inner surface of at least one of the side walls for receiving a spring arm of an EMI shield therein.

12. The housing as described in claim 7, wherein a contact member is assembled to the base.

13. An electrical connector comprising:

an insulative housing including a base, a top wall opposite to the base, and a rear wall formed between the base and the top wall, said top wall defining a locating region and a positioning space thereof;

an LED device including an LED cell positioned on the locating region and at least one leg extending rearward and downward; and a positioning member including a cover detachably positioned in the positioning space, a flange extending forward from the cover for retainably abutting against the LED cell, and a stem extending downward from a rear portion of the cover for abutting against the leg.

14. The connector as described in claim 13, wherein means for securing the positioning member to the housing is provided on the positioning member and on the top wall of the housing.

15. The connector as described in claim 14, wherein said means includes a retaining post extending downward from the cover of the positioning member and a retention hole defined through the top wall so that the retaining post can be snugly received within the retention hole.

* * * * *